United States Patent [19]

Raz

[11] 4,307,923

[45] Dec. 29, 1981

[54] BATHROOM CABINET

[76] Inventor: Zeev Raz, 17 Keren Hayessod St., Beer Sheva, Israel

[21] Appl. No.: 44,096

[22] Filed: May 31, 1979

[30] Foreign Application Priority Data

May 31, 1978 [IL] Israel ..... 54823

[51] Int. Cl.[3] ..... A47B 83/00; A47B 97/00; E03D 1/00

[52] U.S. Cl. ..... 312/237; 4/353; 4/405; 248/226.1; 312/209

[58] Field of Search ..... 312/237, 209, 253, DIG. 33, 312/228; 4/353, 1, 227, 228, 405, 411, 412, 413; 248/226.1, 222.1, 226.4

[56] References Cited

U.S. PATENT DOCUMENTS

| | | | |
|---|---|---|---|
| 1,236,269 | 8/1917 | Cole | 248/226.4 |
| 1,861,802 | 6/1932 | Kelly | 312/237 |
| 2,099,932 | 11/1937 | Isaacson | 312/107 |
| 2,170,776 | 8/1939 | Goepel | 4/353 |
| 2,457,043 | 12/1948 | Histand | 312/DIG. 33 |
| 2,543,438 | 2/1951 | Cochran | 4/411 |
| 3,257,155 | 6/1966 | Worley | 312/228 |
| 3,515,450 | 6/1970 | Jaecke | 312/209 |
| 4,019,793 | 4/1977 | Gerding | 312/209 |
| 4,141,524 | 2/1979 | Corvese | 248/226.1 |

*Primary Examiner*—Roy D. Frazier
*Assistant Examiner*—Alexander Grosz
*Attorney, Agent, or Firm*—Blair, Brown & Kreten

[57] ABSTRACT

The invention provides a cabinet, especially for storing and dispensing sanitary commodities, characterized in that said cabinet is provided with at least one compartment and at least one latchable door and is further provided with means for attachment of said cabinet atop a bathroom flush tank as an integral unit with the cover thereof, whereby said cabinet and cover are readily removable as a unit to allow access to a flushing mechanism within the flush tank in case of malfunction. The invention also is directed to bathroom flush tank covers whenever provided with such a cabinet and to a kit containing such a cabinet and instructions for attachment thereof atop a bathroom flush tank.

10 Claims, 9 Drawing Figures

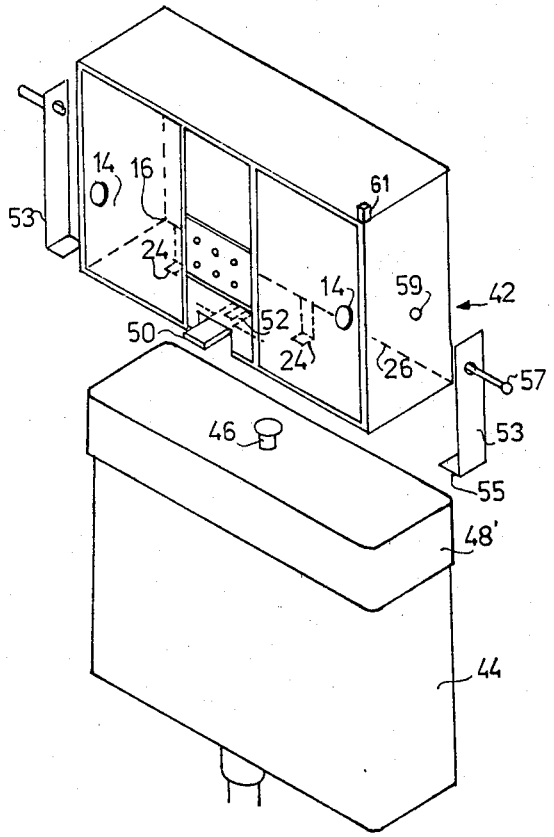
FIG. 3
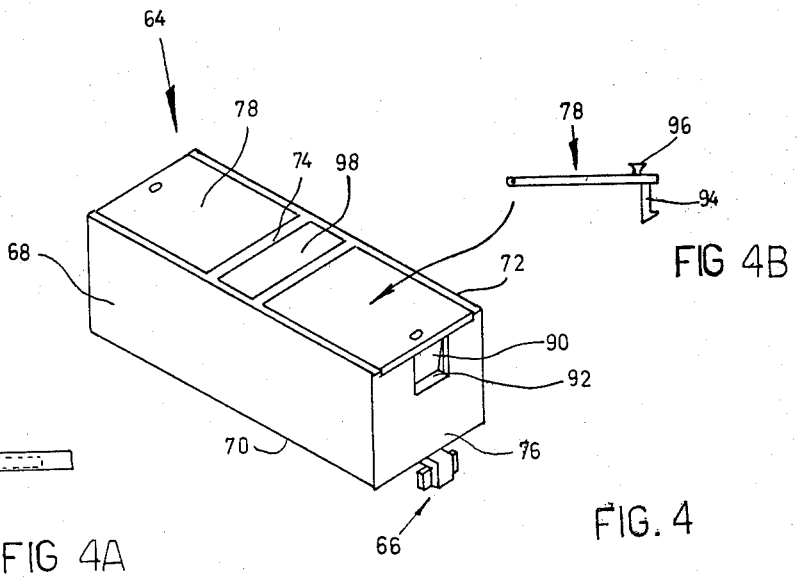
FIG 4B
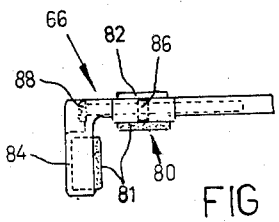
FIG 4A
FIG. 4

BATHROOM CABINET

The present invention relates to bathroom cabinets. More particularly the present invention relates to bathroom cabinets adapted for storing and dispensing sanitary commodities especially in bathrooms of limited space.

The problem of providing an appropriate place to store sanitary commodities in a place which on the one hand is not readily accessible to children or readily visible to visitors to avoid embarrasment and on the other hand is readily accessible to the women of the household in close proximity to the bathroom toilet where used sanitary commodities such as sanitary napkins, pads, tampons etc. are often disposed has todate not yet been satisfactorily solved.

The problem is even more acute in apartments constructed as in many places in Israel wherein one bathroom is provided with a sink and a bath and/or shower and a second very small room is provided containing only a toilet. In said latter type room very often the toilet is situated under a window or vent placed above and behind the toilet and there is simply no place provided in said room where a cabinet can be affixed to a wall since in such a room the only space not needed for headroom is that space above and behind the toilet, which space as indicated is unavailable for use because of the provision of an air-vent or window.

It is therefor an object of the present invention to solve said long outstanding problem and to provide a simple light-weight and inexpensive means enabling the convenient storage and dispensing of sanitary commodities in bathrooms in general and in bathrooms of limited space in particular.

This and other objects, which will be apparent from the specification and claims, is accomplished in accordance with the present invention which is directed to and provides a cabinet, especially for storing and dispensing sanitary commodities, characterized in that said cabinet is provided with at least one compartment and at least one latchable door to provide controlled and limited access thereto and is further provided with means for attachment of said cabinet atop a bathroom flush tank as an integral unit with the cover thereof, whereby said cabinet and cover are readily removable as a unit to allow access to a flushing mechanism within the flush tank in case of malfunction.

The present invention is also directed to bathroom flush tank covers whenever provided with such a cabinet and to a kit containing such a cabinet and instructions for attachment thereof atop a bathroom flush tank.

For lack of space, particularly where the bathroom is relatively small, it has been customary for users thereof to resort to the use of the flush tank cover or lid as a temporary storage spot or support surface for accessories and utilities such as comb and brush, whisk broom, scissors, containers of lotions and cosmetics and so on. As a matter of fact, it is likewise common practice to assist flush tank cover users by providing various forms of shelves and retaining guards such as are quite popular and are in widespread use. Plastic and rubber and equivalent trays, appropriate fence-like racks and so on are exemplary of the state of the art in use to prevent miscellaneous articles from being displaced from the top surface of the cover and falling into an uncovered bowl.

An improved version of such a tray is described in U.S. Pat. No. 3,181,176 which relates to an article retaining band for flush tanks and which claims in combination a toilet flush tank open at its top and provided with a readily applicable and removable lid, a band having a portion thereof snugly encircling a depending marginal edge portion of said lid, means for detachably applying and retaining said band in position on the lid, said band having a portion cooperating with an upper surface of the lid and transforming the same into an article-confining and retaining tray.

As will be realized, however, said patent and similar patents relating to open trays or fence-like arrangements for the flush tank cover do not solve the aforementioned problem of storage of sanitary commodities and do not suggest or teach the presently proposed solution afforded by the cabinet of the present invention.

In the past attempts have been made to design a cabinet to utilize the space above a toilet's flush tank for storage of general bathroom commodities, however these previous attempts have suffered from one or more disadvantages. In some cases the previous constructions prevented or greatly hindered access to the flushing mechanism within the flush tank in case of malfunction also, certain of the previous cabinets were designed for use with only one particular form of flush tank thereby rendering them useless for use with other forms.

In recognition of these problems U.S. Pat. No. 3,093,832 provided a cabinet which is self-supporting by means of a plurality of legs, above the flush tank and provided with a pivotal access panel to enable access to the space between the cabinet and the flush tank and thereby to the interior of the tank and to the flushing mechanism therein in case of need.

As will be realized such a solution involving a complicated and expensive assembly of cabinet, legs, swinging panels etc. while possibly useful for general storage purposes in bathrooms large enough to accomodate such an assembly does not satisfy the need for a simple, lightweight and inexpensive means for storing sanitary commodities in bathrooms of limited space.

Furthermore as will be realized cabinets which are self-supported by legs and/or which are adapted for attachment to a wall above the flush tank inherently face their purchaser with the equally disadvantageous choice of positioning at a comfortably accessible height which often will block easy access to the inwards of the flush tank or positioning high enough to give free access to the flush tank which high positioning is often too high for comfortable frequent use.

In contradistinction to said prior art cabinets and the problems inherent therein as will be described more fully hereinafter in the preferred embodiments of the present invention the cabinet is adapted to be attached to a bathroom flush tank and to form an integral part thereof once attached thereto by forming an integral unit with the cover.

Thus, in accordance with the principles of the present invention it is possible to manufacture a substantially rectangular cabinet having four long sides and two short sides with its door formed in one of said long sides, wherein said attachment means are provided to enable alternative attachment of the long side adjacent or opposite said door atop said flush tank whereby said door is alternatively positioned facing, and accessible from, front or top, while in other preferred embodiments of the present invention said cabinet is adapted to be positioned atop the flush tank and the top of said flush tank is adapted to function as the bottom surface of said cabinet as described hereinafter.

Preferably the cabinet will be made of light-weight plastic to further augment the ease of removal of the cabinet and the tank cover to which it is attached when necessary.

While the invention will now be described in connection with certain preferred embodiments with reference to the following illustrative figures so that it may be more fully understood it is stressed that the particulars shown and described are by way of example and for purposes of illustrative discussion only and are presented in the cause of providing what is believed to be the most useful and readily understood description of the principles and conceptual aspects of the invention. In this regard no attempt is made to show structural details of the cabinet and its components in more detail than is necessary for a fundamental understanding of the invention, the description taken with the drawings making apparent to those skilled in the art how the several forms of the invention may be embodied in practice.

In the drawings:

FIG. 3 is an isometric view of yet another preferred cabinet adapted for attachment to a flush tank having a flush actuating pull handle centered in the top thereof;

FIG. 4 is an isometric view of a multipositional rectangular cabinet, according to the present invention;

FIG. 4A is a side view of preferred attachment means shown in FIG. 4;

FIG. 4B is a side view of door and latch means shown in FIG. 4;

Figure 1:
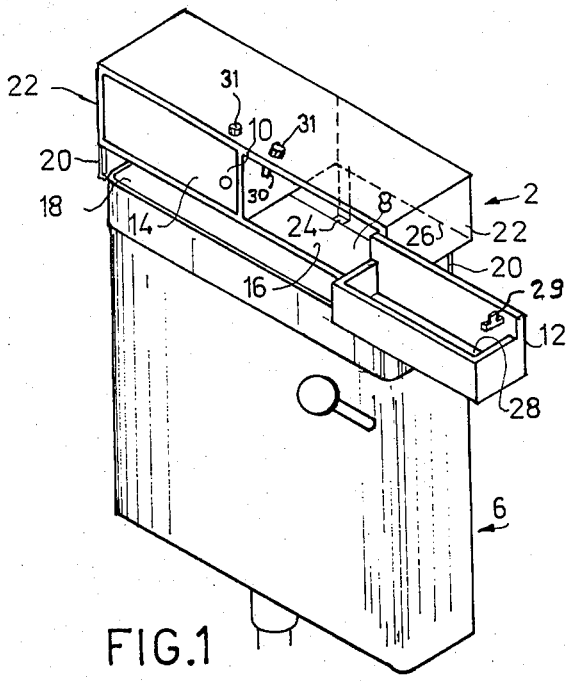
FIG. 1 is an isometric view of a preferred open-bottom bathroom cabinet according to the present invention.
Figure 2:
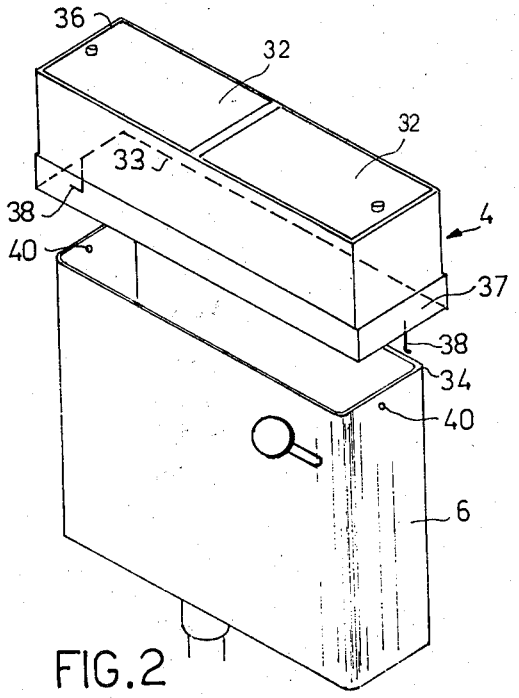
FIG. 2 is an isometric view of another preferred cabinet having a bottom surface adapted to cover an open flush tank.

Referring to FIGS. 1 and 2 there are shown two different preferred cabinets 2, 4 which cabinets are each especially adapted for storing and dispensing sanitary commodities and wherein said cabinets are each adapted to be attached to a bathroom flush tank 6 and to form an integral part thereof. As can be seen both of the cabinets illustrated are adapted to be positioned atop the flush tanks 6, however in different ways as discussed hereinafter with reference to each of the figures in detail.

Referring first to FIG. 1 there is illustrated a preferred type of cabinet 2 according to the present invention having at least two compartments 8, 10 and at least one door 12 and preferably two doors 12 and 14 as shown to provide access thereto; which cabinet is manufactured without a bottom and which consequently is open at its bottom 16 and wherein the top 18 of said flush tank 6 is adapted to function as the bottom surface of said open-bottomed cabinet when said cabinet is positioned atop the flush tank 6.

As can be seen said cabinet is preferably provided with hinged or resilient latches 20 depending from the side walls 22 of said cabinet and adapted to securely affix said cabinet to the cover 18 of the tank 6, whereby said cabinet and cover are readily removable as a unit to allow access to a flush mechanism (not shown) within the flush tank 6 in case of malfunction. Said cabinet is furthermore provided with an additional flange 24 depending from the back wall 26 of the cabinet and adapted to slide between the tank and the wall to which it is affixed and to prevent the forward sliding of said cabinet.

As will be realized the cabinets according to the present invention can be provided with different storage and dispensing possibilities. Thus as shown door 12 can be a swinging door having an outwardly swinging shelf 28 attached thereto and specifically sized to accomodate a plurality of sanitary tampons with their longitudinal axis in horizontal or vertical array while door 14 can be a simple door providing access to compartment 10 which is sized to accomodate a plurality of aligned sanitary napkins.

Both of said doors 12 and 14 are provided with a springy latch 29 adapted to hook onto projections 30 extending respectively into compartments 8 and 10 from the top of the cabinet and to be openable only when the handle of the door is pulled simultaneously with the depression of latch release button 31.

The open-bottomed cabinet described above is especially preferred because of its adaptation to be attached to existing flush tanks and the economy of manufacturing a bottom-less cabinet, however other cabinet arrangements are also possible, e.g., as shown in FIG. 2.

Referring now to FIG. 2 there is illustrated a cabinet 4 which is formed as an integral part of a bathroom flush tank in that said cabinet comprises a bottom surface 33 adapted to be attached to the top 34 of an open flush tank 6 and to form the cover thereof.

This embodiment is preferred for manufacturers of water flush tanks who can supply their customers with ready made flush tanks having cabinets as an integral part thereof at a substantial decrease in expense due to the dual function of bottom 33. While the cabinets can be made with multiple compartments and doors facing front as described with reference to FIG. 1 it is also possible to supply cabinets according to the present invention which cabinets are provided with latchable doors 32 adapted to open upwardly as shown in order to further remove the doors from the attention of children.

The bottom 33 is provided with a depending skirt 37 as found on most flush tank covers and said skirt is provided with two resilient latches 38 adapted to engage bores 40 provided on the sides of the tank 6 for said purpose.

It will be realized that in the above-described and other possible embodiments of the present invention another major advantage achieved is that the cabinet need not be affixed to any wall surface and consequently the problems and difficulties of drilling holes into walls and providing suitable anchors and hooks etc. is eliminated.

Referring now to FIG. 3 where like numbers have been used to indicate like parts as the cabinet of FIG. 1 there is illustrated another preferred cabinet 42 of the present invention especially adapted for attachment to a flush tank 44 of the type in much use in countries outside of Israel having a flush actuating pull handle 46 centered in the top 48 thereof.

As can be seen said cabinet 42 which is also open at its bottom 16 is provided with an actuating lever 50 having one end extending from the front thereof and the other end provided with means e.g., a pair of prongs 52 as shown in broken lines, adapted to engate the actuating pull handle 46 and operate the same when the cabinet 42 is attached, e.g. by means of latches 53 and flanges 24 to the top 48 of the flush tank 44.

Referring now in greater detail to latches 53 said type of latch which comprises a depending lip 55 for engaging the underside of top 48 and screw means 57 for attaching said flange to an appropriate aperture 59 provided in cabinet 42 is preferred due to its adaptability for attachment to flush tank tops of different lengths.

Said cabinet is also provided with at least one special latch release 61 similar to that described with reference to FIG. 1 which is difficult for children to open whereby at least one of the compartments can be used for storing sanitary commodities without children having access thereto.

Referring now to FIGS. 4, 4A and 4B there is shown an especially preferred multipositional cabinet 64 according to the present invention and preferred attachment means 66 therefor.

As seen said cabinet 64 is substantially rectangular comprising four long sides 68, 70, 72 and 74 and two short sides 76 and is provided with two doors 78 (FIG. 4B) in one of said long sides 74.

Said cabinet is preferably manufactured without integral attachment means so that attachment means can be attached by the purchaser alternatively to a long side, e.g., 68 or 72 adjacent said doored side 74 or to the long side 70 opposite said door 78 whereby upon attachment of said attachment means to the chosen long side and the subsequent attachment of the cabinet by means thereof to the flush tank cover, said door, or doors, 78 are alternatively positioned facing, and accessible from, front or top as desired.

As will be realized, different attachment means could be used as described hereinafter with reference to FIGS. 4A, 4C and 6, however, said cabinet will first be described with reference to attachment means 66 as shown in greater detail with reference to FIG. 4A. Said attachment means 66 comprises leg means 80 attachable to the chosen bottom surface of said cabinet by means of an adhesive surface 82 or by the provision of screw attachment holes (not shown) therein. Said leg means 80 is preferably provided, as shown, with a cushion 81 of yieldingly pliable material, such as a felt like material or structurized foam rubber, to allow for adaptation to the configuration and possible curvature of different cistern tops of different manufacturers. Said leg means further include variably extendable depending gripping flanges 84 adapted to grip the depending side skirts of the flush tank cover (not shown) wherein said extendable gripping flanges 84 enable the attachment of said cabinet atop flush tank covers of varying widths.

As shown the variable extension of said depending flanges can be made possible by providing said leg means 80 with an internal fixed nut 86 and providing said flanges with screw means 88 passing through said nut which also enable the tightening of the gripping flanges 84 against said cover skirt sides.

Another preferred feature of the cabinet shown is the provision of an opening 90 on the side 76 of said cabinet which opening is provided with an inwardly facing lip 92 adapted to engage and catch resilient latch means 94 attached to door 78 whereby said door can be opened only upon the insertion of a finger through opening 90 to release latch 94 while simultaneously pulling on handle 96.

Yet another preferred feature of this embodiment and also of other embodiments of the type referred to in FIG. 1 (however not shown there) is the provision of a removable panel 98 in the top 74 of said cabinet, and also in the bottom 70 when said cabinet has its own integral bottom as shown, to provide a cabinet utilizable both with flush tanks 6 (FIGS. 1 and 2) having handles on their front face and with flush tanks 44 (FIG. 3) having a flush actuating pull handle 46 centered in the top thereof, in which latter case panels 98 are simply removed and an extended pull handle is attached therethrough to pull handle 46.

Figure 4C:
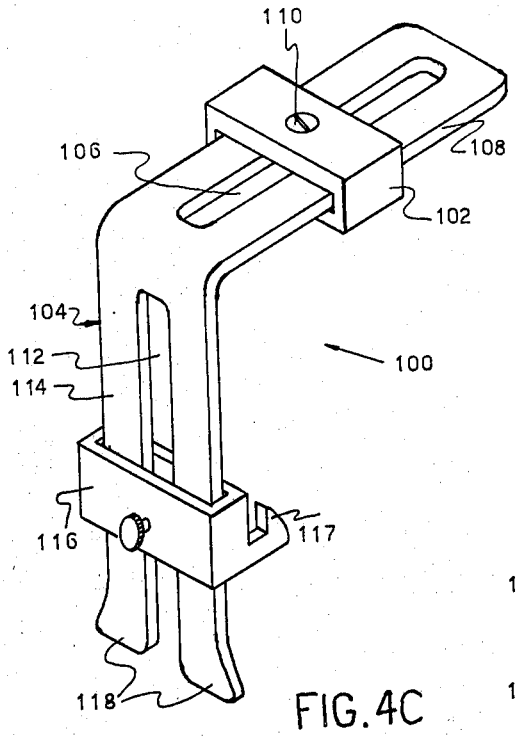
FIG. 4C is a side view of an especially preferred alternative attachment means.

Referring now to FIG. 4C there is shown another especially preferred attachment means which can be used instead of means 66 described with reference to FIGS. 4 and 4A. As with means 66 this attachment means 100 comprises leg means 102 attachable to the chosen bottom of the cabinet and includes a variably extendable depending flange 104 adapted to engage depending shirt sides of the cover of said flush tank (not shown). In this preferred embodiment said gripping flange 104 is provided with a first slot 106 made in limb 108 to make possible the variable extension of said depending flange by loosening and tightening bolt 110 provided in leg means 102. Said flange is also provided with a second open-ended slot 112 extending along the second limb 114 thereof on which limb 114 there is slidably adjustably mounted a fastening bracket 116 provided with engaging hooking means 117 adapted to engage the underlip of said tank cover skirt (not shown). As will be realized the provision of slidable bracket 116 enables the attachment of the cabinet to skirts of different lengths as well as different widths without reliance on pressure clamping as with means 66. As will be further noted the ends 118 of limb 114 can be widened as shown so that after bracket 116 is mounted thereon (by inwardly flexing said springy ends 118 towards each other) said bracket cannot accidently disengage itself from said limb 114 or be lost. Of course other similar arrangements to ensure that the bracket does not become disengaged from the limb can also alternatively be provided.

Figure 5:
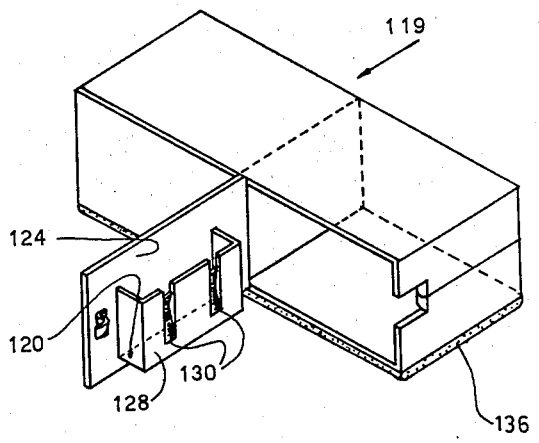
FIGS. 5 and 6 are isometric views of multipositional rectangular cabinets provided with especially preferred swingable shelf arrangements according to the present invention.
Figure 6:
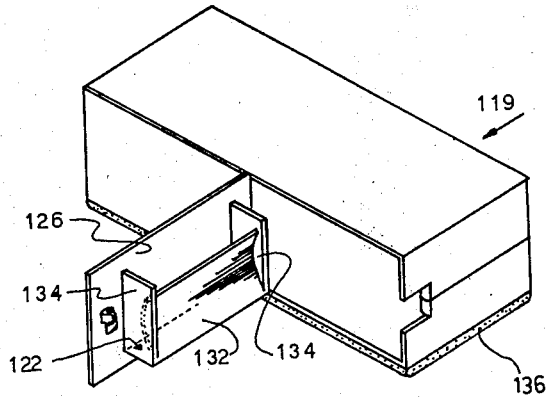

Referring now to FIGS. 5 and 6 there are shown two identical cabinets 119 varying only in the features of the shelves 120 and 122 provided respectively on the inside of doors 124 and 126 which doors are both shown in a swung open position.

Referring first to FIG. 5 there is shown swinging door 124 having an attached and therefor outwardly swingable shelf 120 wherein said shelf is provided with a guard wall 128 having a plurality of inwardly bent springy tabs 130 for retaining and clamping boxes of sanitary commodities placed within the swinging compartment formed by the back of said door 124, the shelf 120 and said guard wall 128, whereby items can be easily withdrawn from said box without the whole box or its contents being dislodged.

Referring now to FIG. 6 there is shown an especially preferred swinging shelf compartment 122 having front 132 and side 134 guard walls wherein said front wall 132 is inwardly bent and flexibly mounted on said shelf 122 so as to clamp sanitary articles and/or sanitary article-containing boxes between said front wall 132 and the back of door 126.

While the latchable doors of the present invention have been illustrated in the figures as swinging doors with or without attached compartments it will be realized that said doors can also form part of a slidable drawer if desired.

In both FIGS. 5 and 6 there is shown an especially preferred attachment means 136 comprising a cushion of yieldably pliable material such as felt or structurized foam rubber adapted to have one side glued to the chosen bottom side of a cabinet and the other side glued to the top of a bathroom flush tank. Said yieldingly pliable or compressable material enables the attachment of a cabinet atop cistern tops of different configurations and curvatures and usually need not have a thickness exceeding 3–5 mm to achieve its effect. Said materials also have sufficient shear strength to avoid displacement of the cabinet once attached and are much less expensive than attachment means 66 or 100 described hereinbefore.

While particular embodiments of this invention have been described, it will be evident to those skilled in the art that the present invention may be embodied in other specific forms without departing from the essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed is:

1. A cabinet, especially for storing and dispensing sanitary commodities, characterized in that said cabinet is provided with at least one compartment and at least one latchable door, wherein said latchable door is provided with a shelf attached to the inner side thereof which shelf is provided with a guard wall to form an outwardly openable compartment in the area defined by the inner side of said door, said shelf and said guard wall said compartment being provided with a plurality of bent springy tabs for clamping and for retaining various sized items placed within said compartment, and said cabinet is further provided with means for attachment of said cabinet atop a bathroom flush tank as an integral unit with the cover thereof, whereby said cabinet and cover are readily removable as a unit to allow access to a flushing mechanism within the flush tank in case of malfunction.

2. A cabinet according to claim 1 wherein said cabinet is open at its bottom and wherein the top of said flush tank constitutes the bottom surface of said cabinet upon the attachment of said cabinet thereto.

3. A cabinet according to claim 1 wherein said cabinet comprises a bottom surface adapted to be attached to the top of an open flush tank to form the cover thereof.

4. A cabinet as claimed in claim 1 especially for attachment to a flush tank of the type having a flush actuating pull handle extending from the top thereof wherein said cabinet is provided with an actuating lever having one end extending from the front thereof and the other end provided with means to engage said actuating pull handle and operate the same when the cabinet is attached to the top of the flush tank.

5. A substantially rectangular cabinet as claimed in claim 1 having four long sides and two short sides with said door formed in one of said long sides wherein said attachment means are provided to enable alternative attachment of the long side adjacent or opposite said door atop said flush tank whereby said door is alternatively positioned facing, and accessible from, front or top.

6. A cabinet as claimed claim 1 wherein said attachment means comprise leg means attachable to the bottom of said cabinet and include variably extendable depending flanges adapted to grip depending skirt sides of said flush tank cover wherein said extendable gripping flanges enable the attachment of said cabinet atop flush tank covers of varying widths.

7. A cabinet as claimed in claim 1 wherein said latchable door is a swinging door having a shelf attached to the inner side therof which shelf is provided with a guard wall to form an outwardly swingable compartment in the area defined by the inner side of said door, said shelf and said guard wall and wherein at least a portion of said guard wall is inwardly and resisiently bent for retaining and clamping items placed within said swinging compartment.

8. A cabinet as claimed in claim 1 wherein said means for attachment comprise a cushion of yieldably pliable material attachable to the bottom of said cabinet and gluable to the top of said flush tank cover.

9. A bathroom flush tank cover wherever provided with a cabinet as claimed in claim 1.

10. A bathroom cabinet kit comprising a cabinet as claimed in claim 1 and instructions for attachment of said cabinet atop a bathroom flush tank as an integral unit with the cover thereof.

* * * * *